US006095627A

United States Patent [19]

Sutterlütti

[11] Patent Number: 6,095,627

[45] Date of Patent: Aug. 1, 2000

[54] DRAWER SIDE WALL

[75] Inventor: Harald Sutterlütti, Fussach, Austria

[73] Assignee: Julius Blum Gesellschaft m.b.H., Höchst, Austria

[21] Appl. No.: 09/337,545

[22] Filed: Jun. 22, 1999

[30] Foreign Application Priority Data

Jun. 24, 1998 [AT] Austria ..... 1092/98

[51] Int. Cl.[7] ..... A47B 47/00

[52] U.S. Cl. ..... 312/348.2; 312/263

[58] Field of Search ..... 312/263, 334.14, 312/334.15, 348.1, 348.2, 330.1

[56] References Cited

U.S. PATENT DOCUMENTS 5,348,386 9/1994 Grass ..... 312/348.2
5,494,348 2/1996 Grabher ..... 312/263
5,556,183 9/1996 Brustle et al. ..... 312/348.1
5,992,958 11/1999 Scheible ..... 312/348.1

FOREIGN PATENT DOCUMENTS 85 10 835 7/1985 Germany .
92 16 508 4/1993 Germany .

*Primary Examiner*—Peter M. Cuomo
*Assistant Examiner*—Jerry A. Anderson
*Attorney, Agent, or Firm*—Wenderoth, Lind & Ponack, L.L.P.

[57] ABSTRACT

A drawer side wall made of metal with a horizontal supporting flange for supporting a bottom plate of a drawer. The drawer side wall is provided with manually operateable clamping devices for clamping the bottom plate.

17 Claims, 15 Drawing Sheets

DRAWER SIDE WALL

FIELD AND BACKGROUND OF THE INVENTION

The invention relates to a drawer side wall preferably made of metal with a horizontal supporting flange for supporting a bottom plate of a drawer.

Generally, the bottom plate of a drawer, which is made out of wood is fastened to the drawer side walls by means of screws.

EP 0 429 428 A2 discloses a drawer side wall made of metal which has a supporting flange for a bottom plate, the supporting flange has a plurality of flaps which are punched out of the supporting flange. The flaps protrude into grooves at the bottom side of the bottom plate.

Fastening a bottom plate to a drawer side wall by means of screws is timeconsuming. Fastening of the bottom plate to the supporting flange of a drawer side wall by means of flaps which are punched out of the supporting rails can be done quickly. However, in most cases it is necessary to use a special tool so that this method of fastening is only applied when a large number of drawers is to be assembled. Furthermore, a drawer plate, which is fastened to the drawer side wall in this way, can only be detached with difficulties. In most cases the drawer side wall or the bottom plate will be damaged.

SUMMARY OF THE INVENTION

It is the object of the invention to provide an improve structure of a drawer side wall whereby the bottom plate of a drawer can be fastened to the side wall quickly and without a tool and can be detached easily.

According to the invention this is achieved by at least one manually operatable clamping device which is mounted on said horizontal supporting flange for clamping said drawer bottom plate toward said cover strip.

With a drawer side wall according to the invention it is not necessary to provide the bottom plate with grooves or holes for the insertion of fastening elements.

BRIEF DESCRIPTION OF THE DRAWINGS

In the following embodiments of the invention will be described in more detail with reference to the accompanying drawings in which.

DETAILLED DESCRIPTION OF PREFERRED EMBODIMENTS

Figure 1:
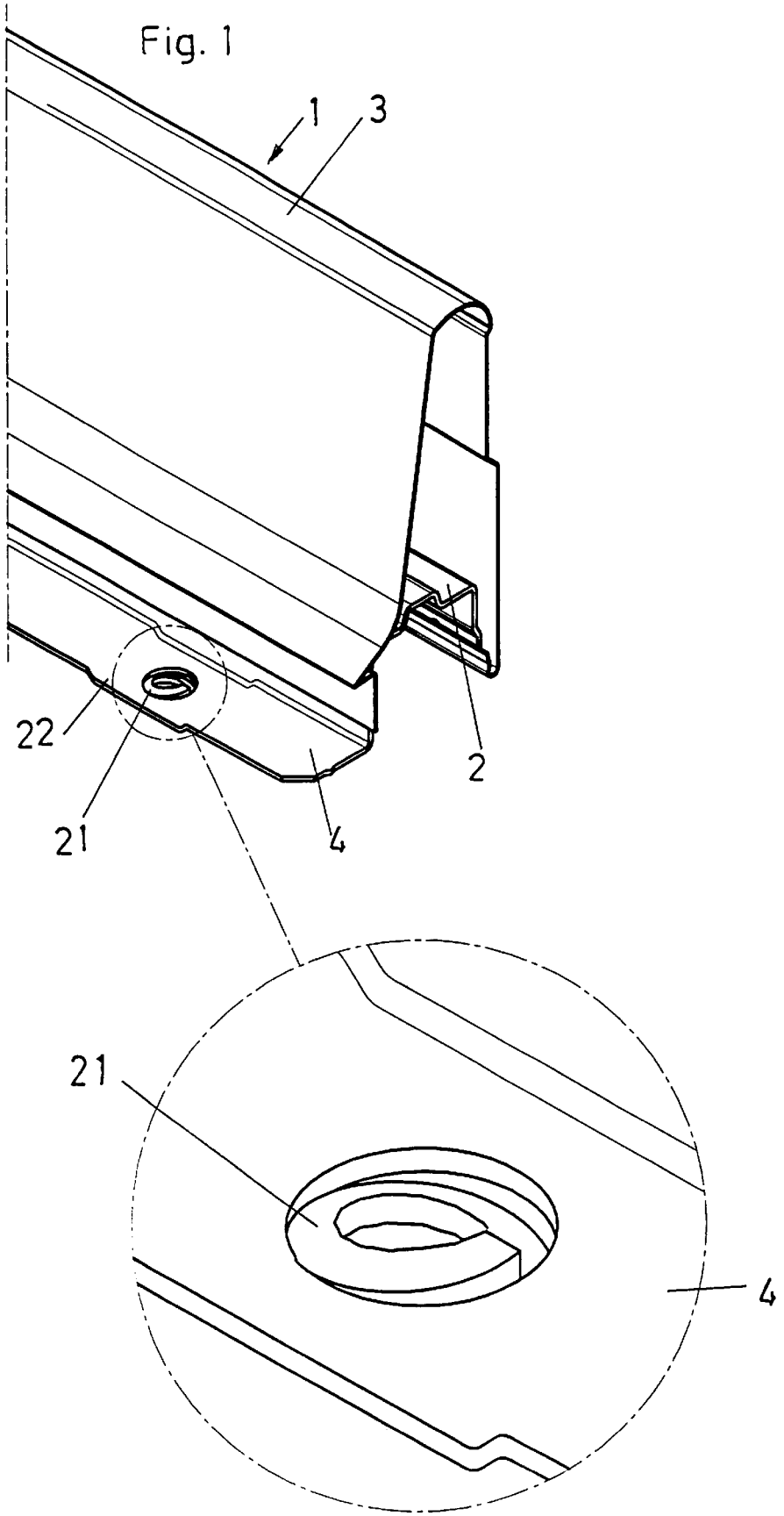
FIG. 1 is perspective view of the front end of a drawer side wall.
Figure 2:
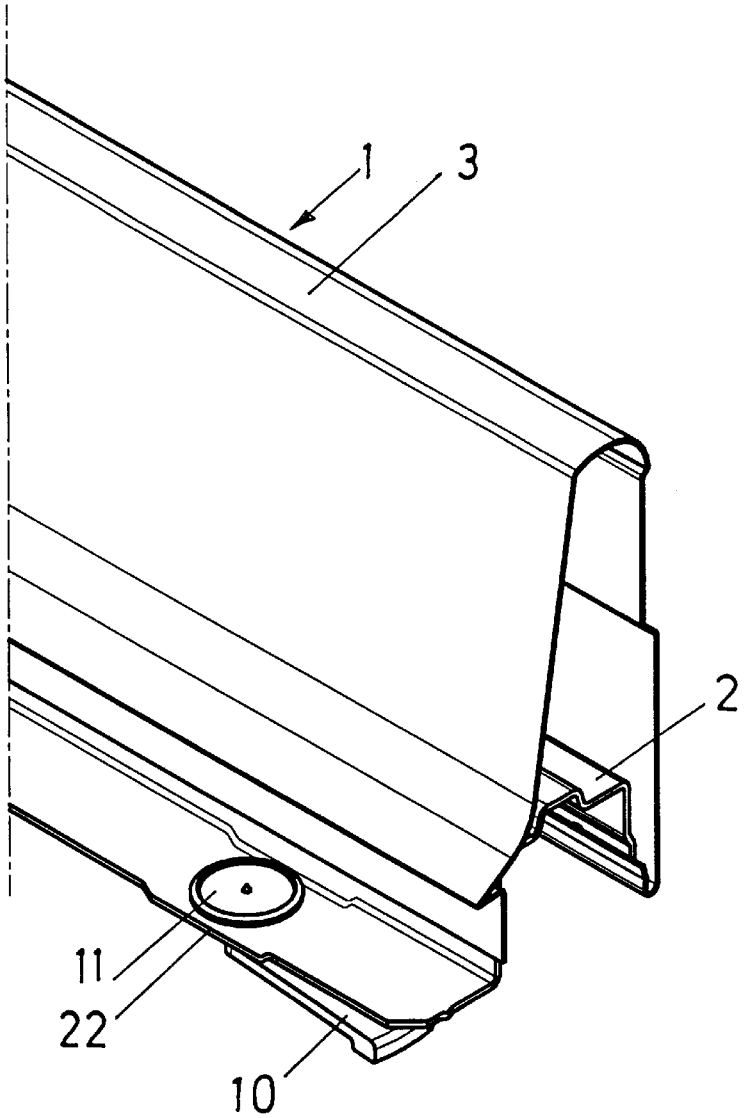
FIG. 2 is a perspective view of the front end of a drawer side wall with a clamping device according to the invention.
Figure 3:
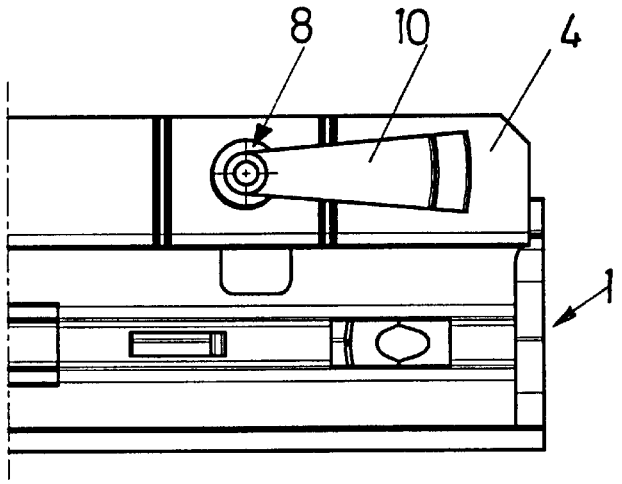
FIG. 3 is a plan view of the bottom of front end of a drawer side wall and the clamping device.

Generally a drawer consists of two drawer side walls 1, a bottom plate 7, a drawer rear wall and a front wall. In the drawings only one drawer side wall 1 and part of the bottom plate 7 are shown.

The drawer side wall 1 consists of a lower part 2 and a upper part 3. The lower part 2 can have the function of a pull-out rail of pull-out guide assembly or such a pull-out rail can be coupled to the lower part 2.

The upper part 3 of the drawer side wall 1 has an outer wall 3' and an inner wall 3".

The outer wall 3' is hooked into the lower part 2 by means of a jointed-flange connection 5.

The inner wall 3" is provided with a horizontal cover strip 6 covering the side of the bottom plate 7 in such a way that no dirt particles can fall into the gap between the bottom plate 7 and the adjacent vertical flange of the lower part 2 of the drawer side wall 1.

In the embodiment shown the drawer side wall 1 is made out of metal preferably sheet steel and the bottom plate 7 is made out of a wooden material such as a chip board. There are no grooves or holes in the bottom plate 7.

In the embodiments according to FIGS. 1 to 9 the clamping devices 8 comprise clamping parts which are rotatable around a vertical axis (the expressions vertical and horizontal refer to the normal position of a drawer in a cabinet).

In this embodiment the clamping devices 8 comprise threaded bolts 9 which are screwed into female threads 10 in the horizontal supporting flange 4 of the lower part 2 of the drawer side wall 1.

Preferably two clamping devices 8 and bolts 9 are provided for each drawer side wall 1, whereby one bolt 9 is positioned at the front end of the drawer side wall 1 and the second bolt 9 is positioned near the rear end of the drawer side wall 1.

Each bolt 9 is provided with a handle 10 which is situated underneath the horizontal supporting flange 4. At the end of the bolt 9, which is directed towards the bottom plate 7, a clamping disc 11 is provided.

Figure 4:
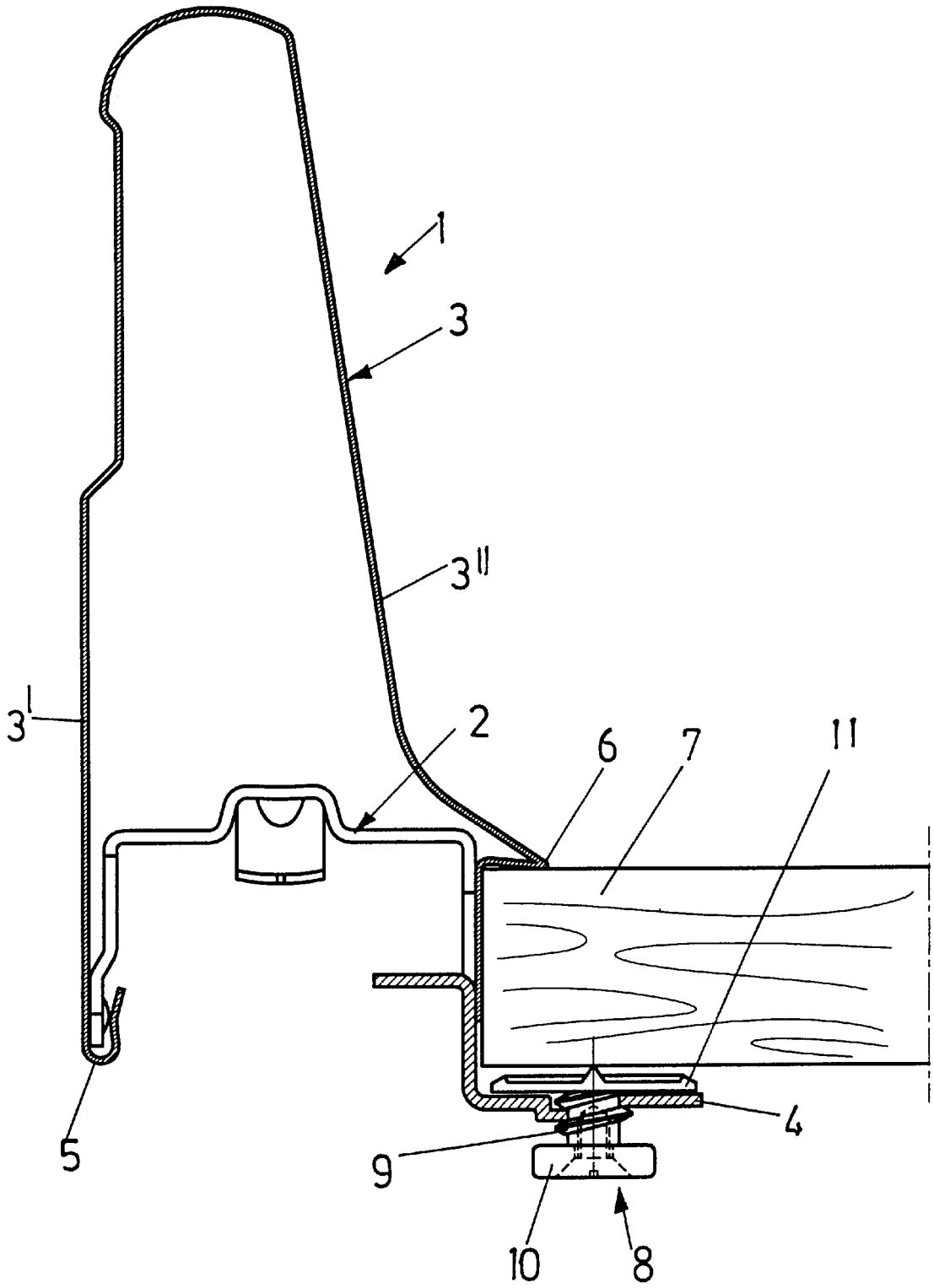
FIG. 4 is a cross section of the drawer side wall in the range of the clamping device, the bottom plate not being clamped by the clamping device.

When the bolt 9 is in the non-clamping position as shown in FIG. 4 and the clamping disc 11 abuts the horizontal supporting flange 4, the bottom plate 7 can be inserted into the gap between the cover strip 6 and the horizontal supporting flange 4.

By turning the handle 10, the clamping disc 11 is moved towards the bottom plate 7 and presses the bottom plate 7 towards the cover strip 6. Thereby the bottom plate 7 is tightly clamped between the cover strip 6 and the bolt 9 of the clamping device 8.

To improve the hold on the bottom plate 7, the clamping disc 11 can be provided with protruding holding means for example a point 12 situated in the middle of the disc 11 and directed towards the bottom plate 7 which cuts into the bottom plate 7 when the clamping means 8 are in the clamping position. Also a cutting rim 13 can be provided alone or in combination with the point 12.

Figure 5:
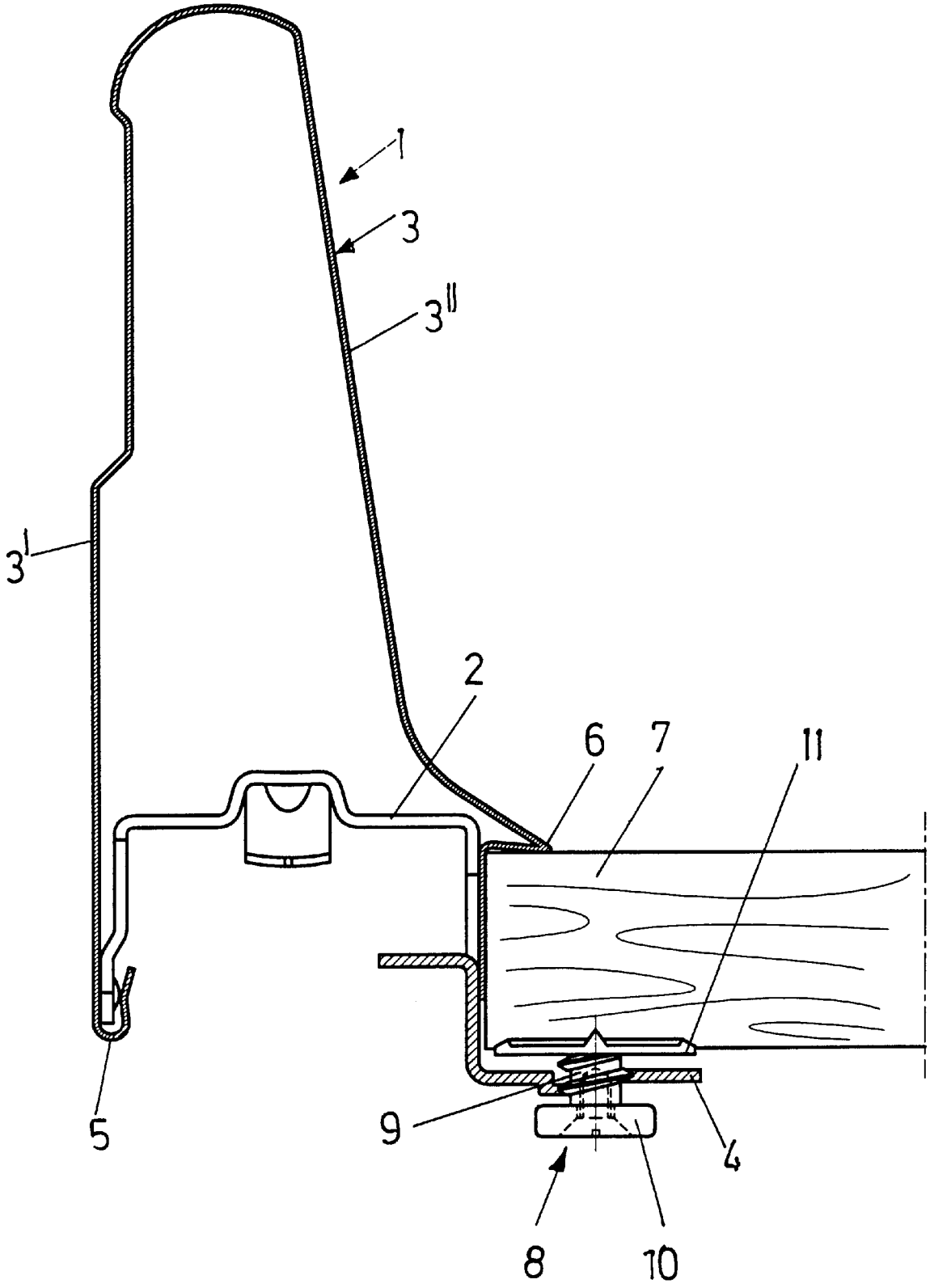
FIG. 5 is a cross section of the drawer side wall in the region of the clamping device, the bottom plate being clamped by means of the clamping device.
Figure 6A:
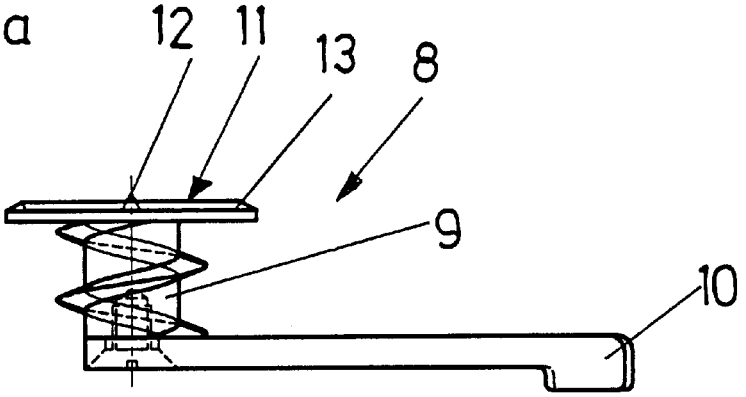
FIG. 6*a* is a side view of the clamping device.
Figure 6B:
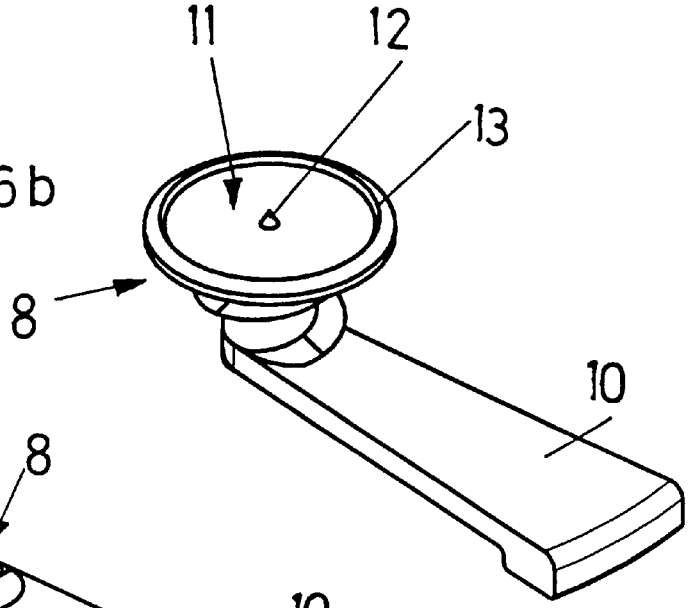
FIG. 6*b* is a perspective view of an embodiment of the clamping device seen from above.
Figure 6C:
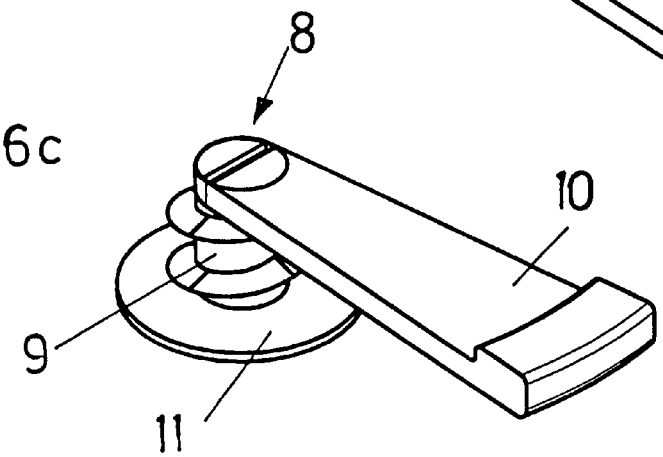
FIG. 6*c* is a perspective view of the clamping device seen from below.
Figure 7:
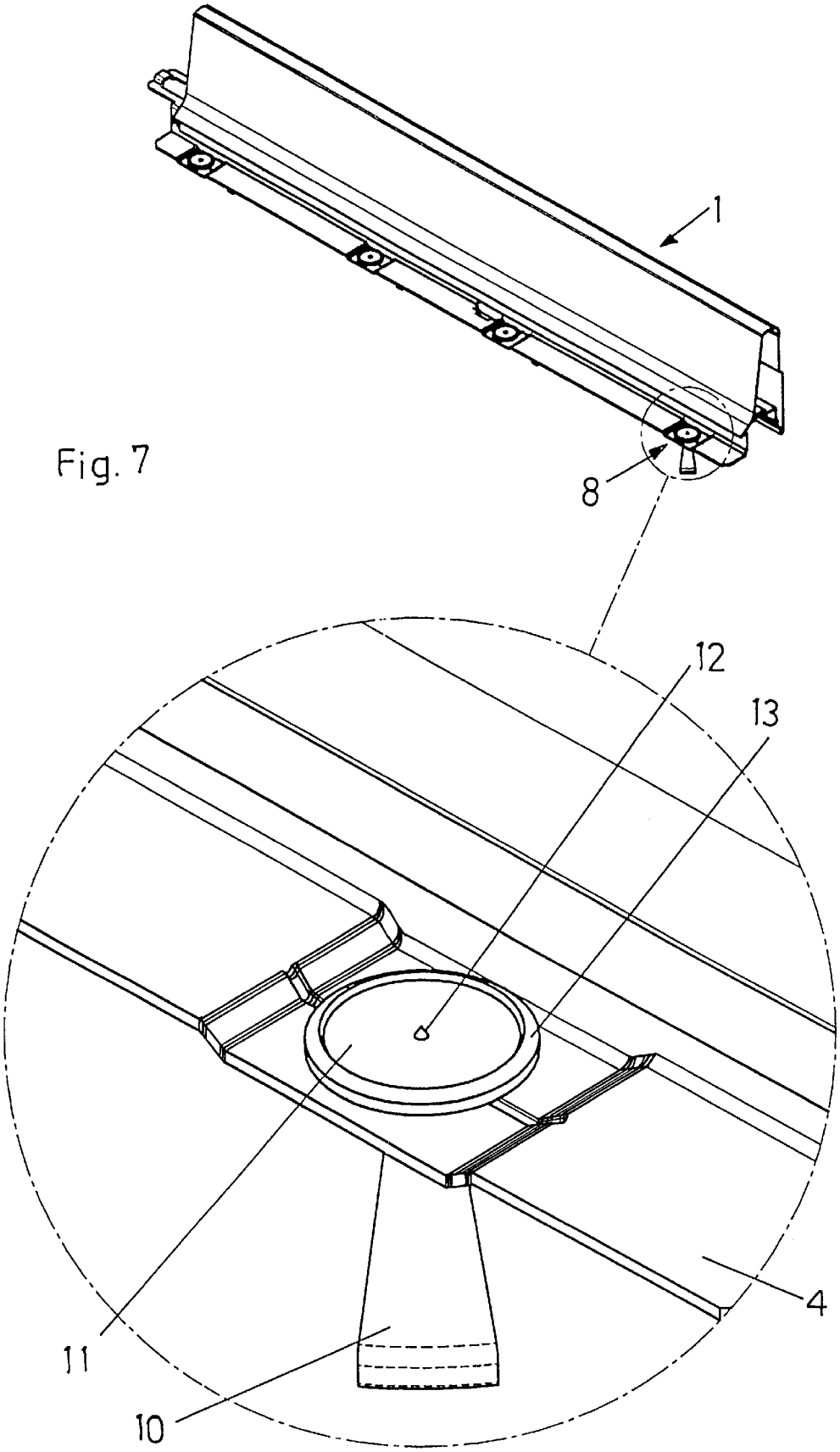
FIGS. 7 to 9 are perspective views of a drawer side wall showing different embodiments of the clamping device.
Figure 8:
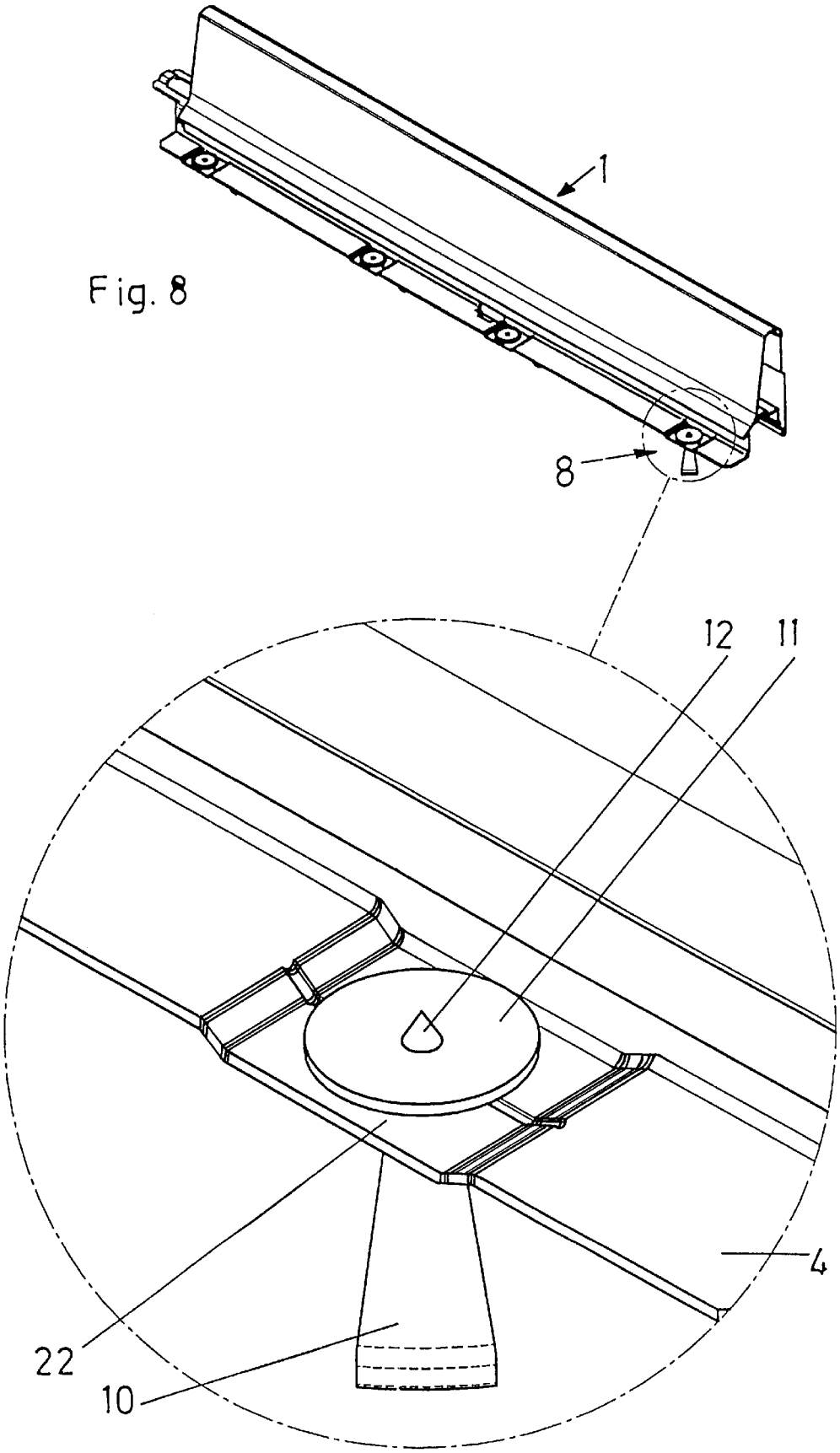
Figure 9:
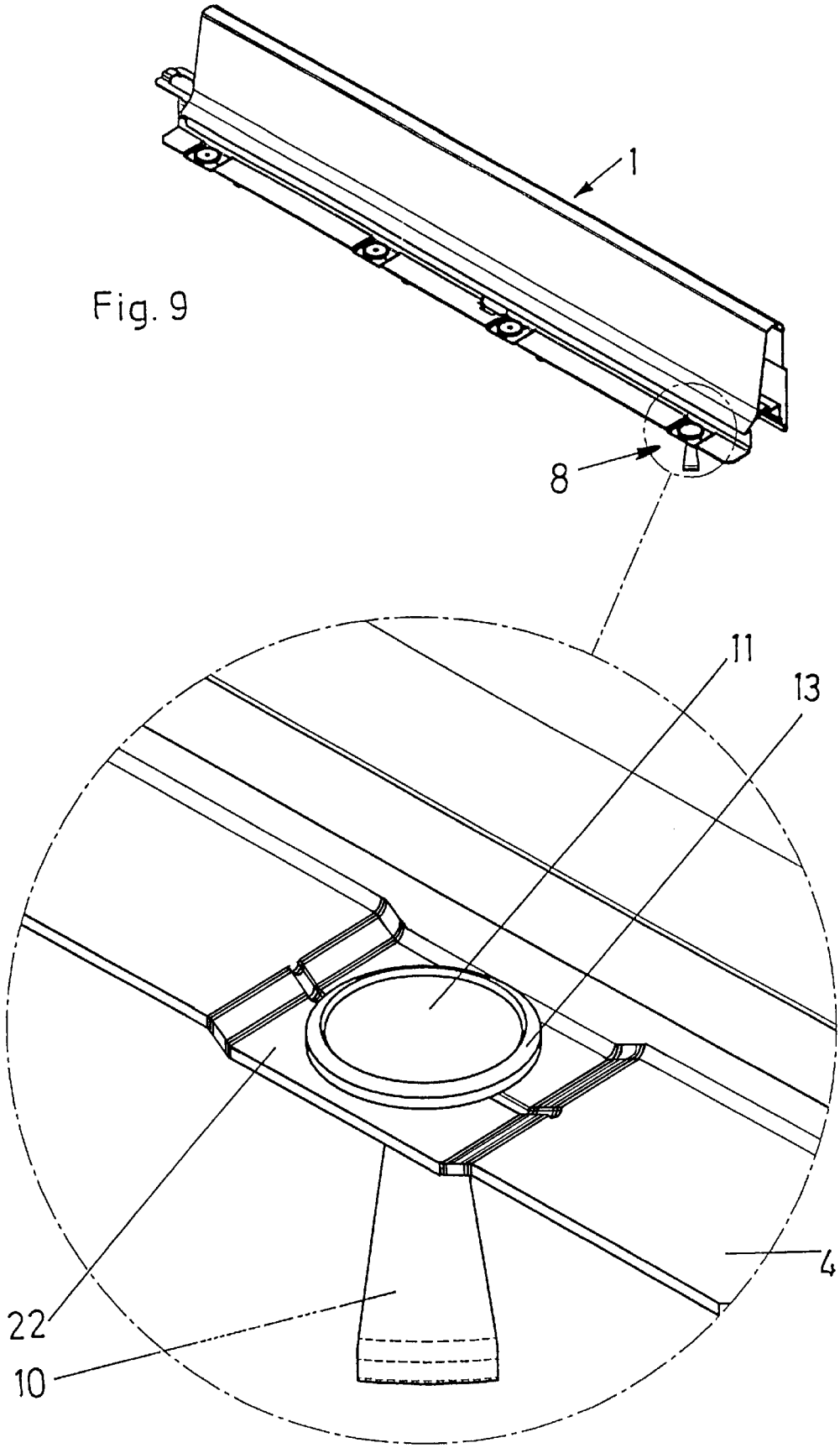
Figure 10:
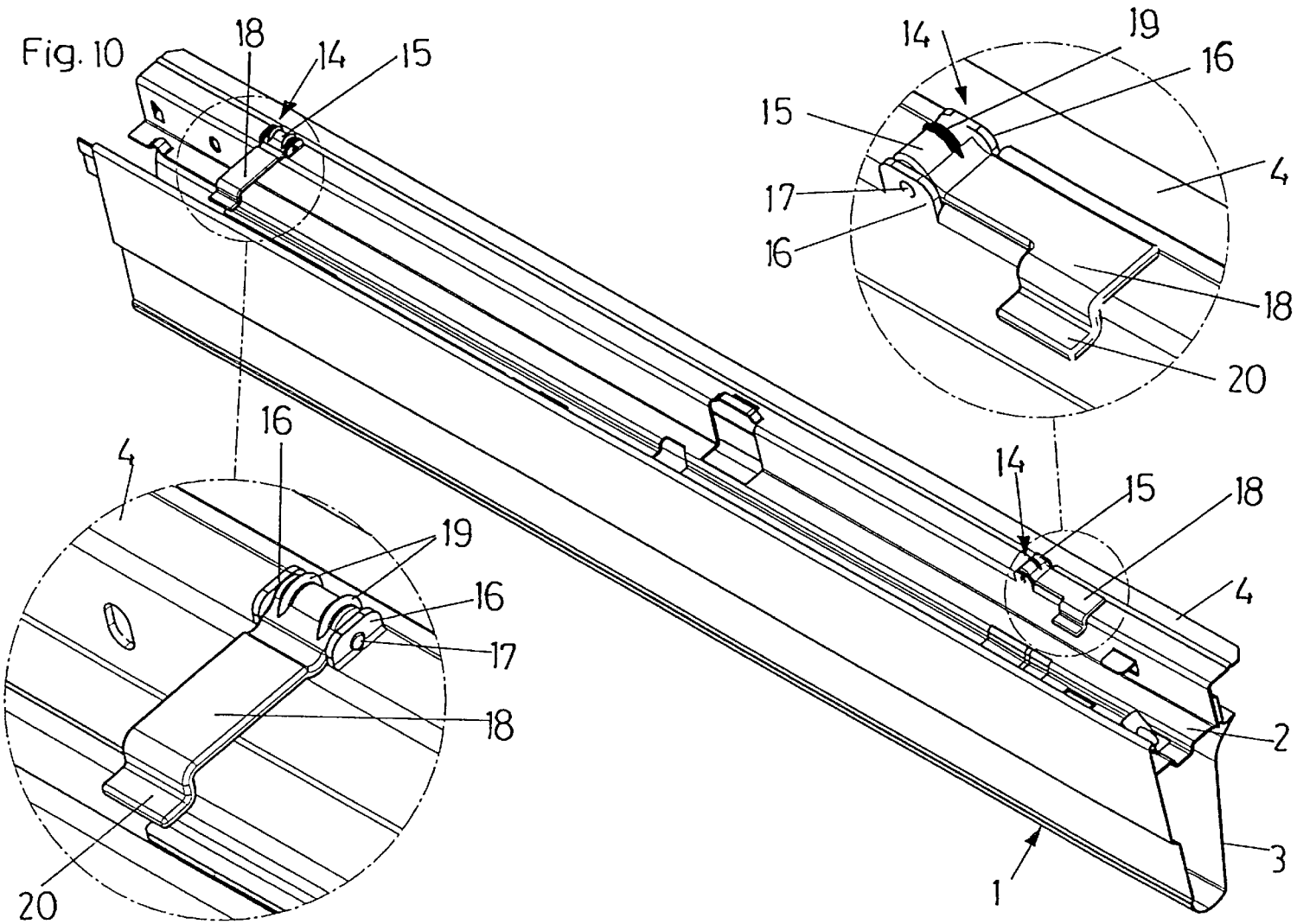
FIG. 10 is a perspective view of a drawer side wall seen from below.

In the clamping position shown in FIG. 5 the handle 10 of the clamping device 8 is aligned parallel to the drawer side wall 1 and is covered by the horizontal supporting flange 4.

In the embodiment of FIGS. 10 to 17 the drawer side wall 1 is provided with clamping devices 14 comprising rollers 15 by means of which the bottom plate 7 is clamped.

The drawer side wall 1 is constructed in the same way as in the embodiments described before with an upper part 3 and a lower part 2, the later comprising a horizontal supporting flange 4 for the bottom plate 7.

Again the clamping devices 14 are mounted on the supporting flange 4. For each clamping device 14 the support flange 4 is provided with two downwardly protruding flaps 16 in which an axle 17 of a roller 15 is held. The rollers 15 are aligned horizontally whereby the axis of the roller 15 which is nearer to the rear end of the drawer side wall 1 is aligned in longitudinal direction of the drawer side wall 1 and the axis of the roller 15 which is nearer to the front end of the drawer side wall 1 is perpendicular to the longitudinal extension of the drawer side wall 1.

In the embodiment shown the drawer side wall 1 is provided with two clamping devices 14 that is also with two rollers 15. Each roller 15 is provided with a handle 18 which makes manual turning of the roller 15 possible without the use of a tool.

The roller 15 which is situated nearer to the rear end of the drawer side wall 1 is provided with two cutting rings 19 which cut into the wooden material of the bottom plate 7 when the bottom plate 7 is clamped. The roller 15 which is situated nearer to the front end of the drawer side wall is provided with only one cutting ring 19 which is nearer to the end of the roller 15 which is directed towards the inner wall of the drawer side wall 1 then to the other end.

Figure 11:
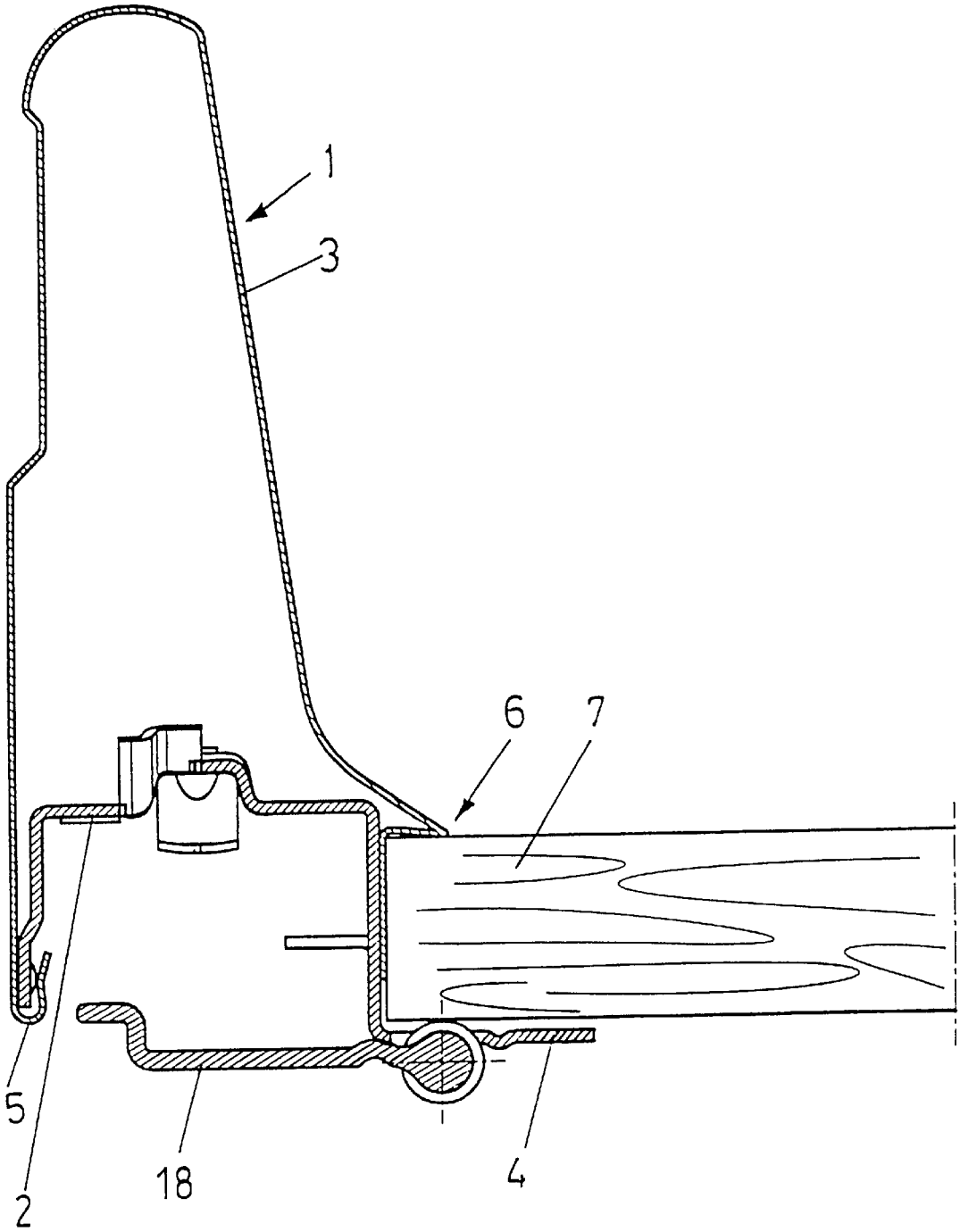
FIG. 11 is a cross section of a drawer side wall and a bottom plate, the clamping device being in the non-clamping position.
Figure 12:
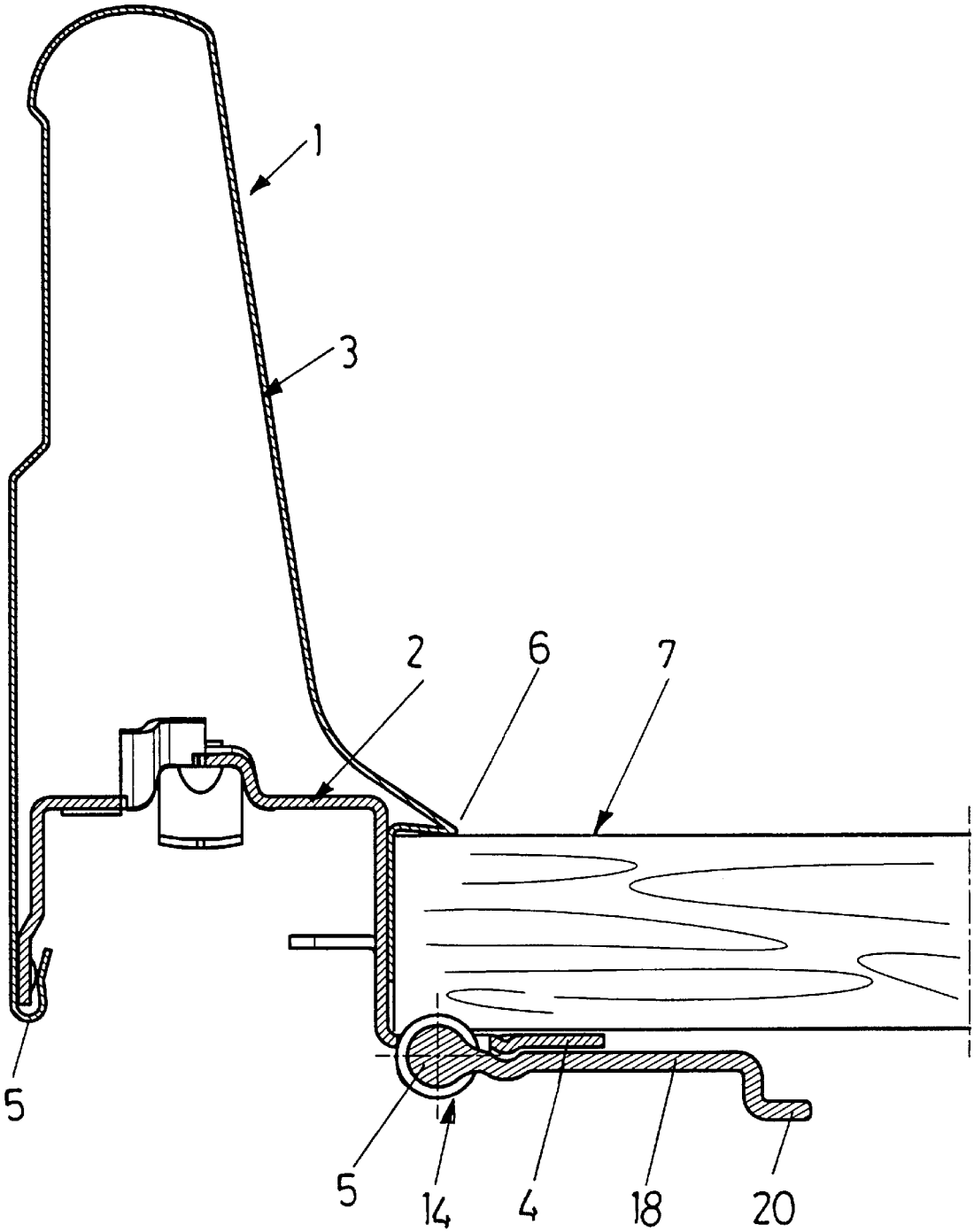
FIG. 12 is a cross section of a drawer side wall and a bottom plate, the clamping device being in the clamping position.
Figure 13:
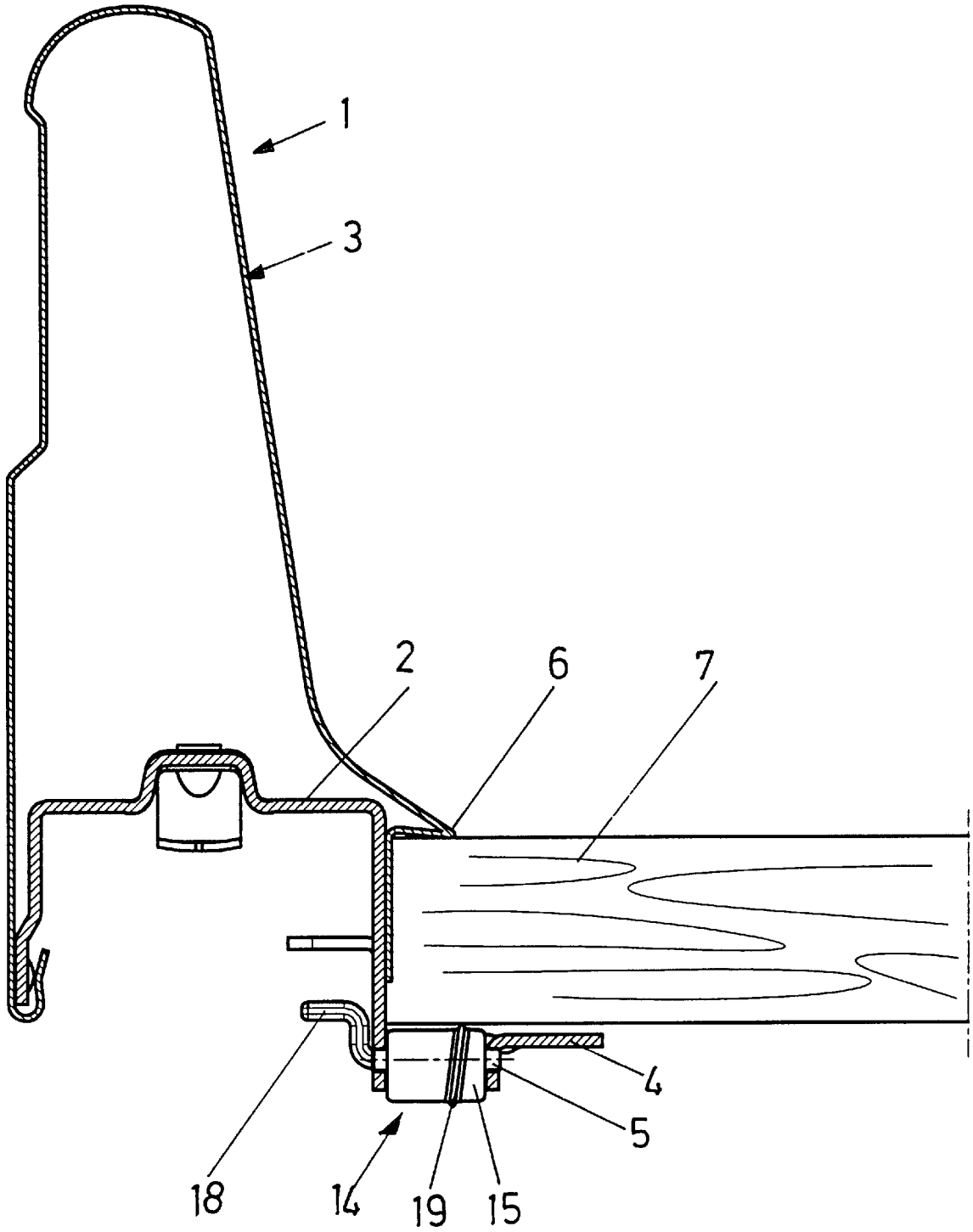
FIG. 13 is a cross section of a drawer side wall and a bottom plate, the clamping device being in the non-clamping position.

In the position of the clamping device 14 in which the bottom plate 7 can be inserted between the horizontal support flange 4 and the cover strip 6, the handle 18 of the rear clamping device 14 is in the position shown in FIG. 11. To clamp the bottom plate 7, the handle 18 and the roller 15 are turned. In the clamping position, the handle 18 is in the position shown in FIG. 12. In this position, the cutting rings 19 of the roller 15 cut into the bottom plate 7 and the bottom plate 7 itself is pressed against the cover strip 6.

To make loosening of the clamping means 14 easier, the handles 18 are provided with an angular part.

Figure 14:
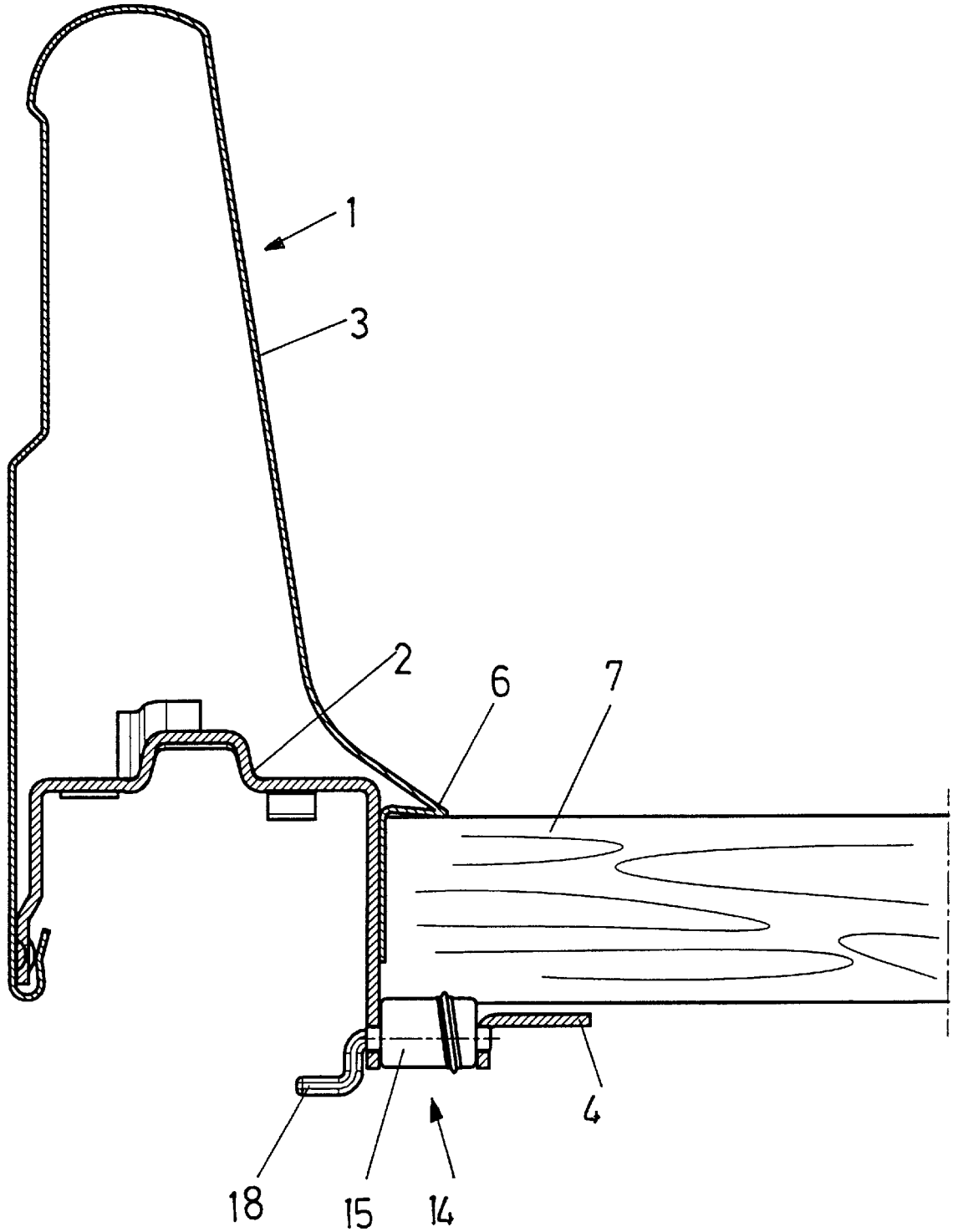
FIG. 14 is a cross section of a drawer side wall and a bottom plate, the clamping device being in the clamping position.
Figure 15:
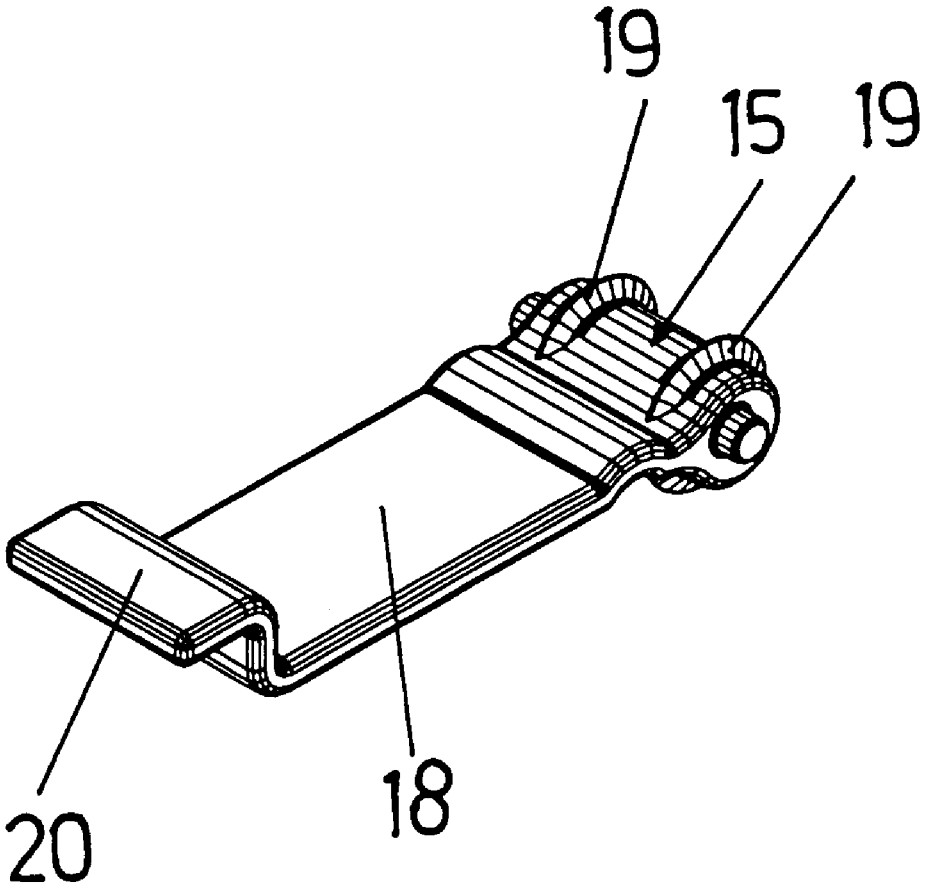
FIGS. 15 to 17 are perspective views of different embodiments of the clamping device.
Figure 16:
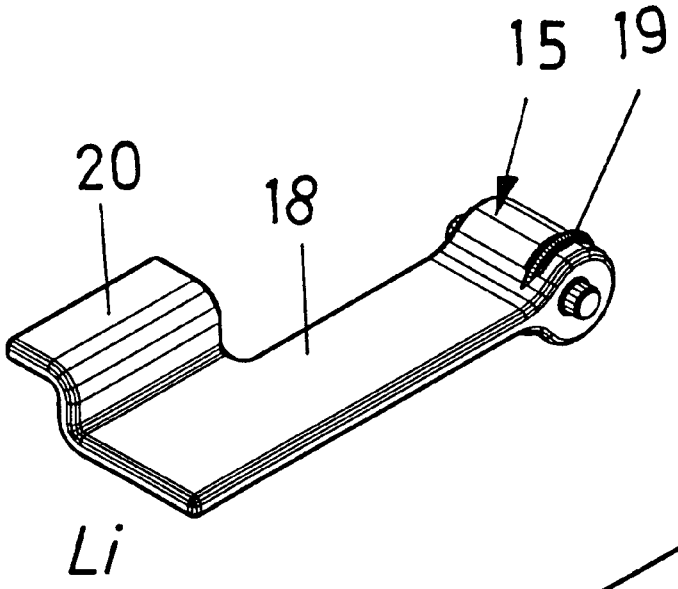
Figure 17:
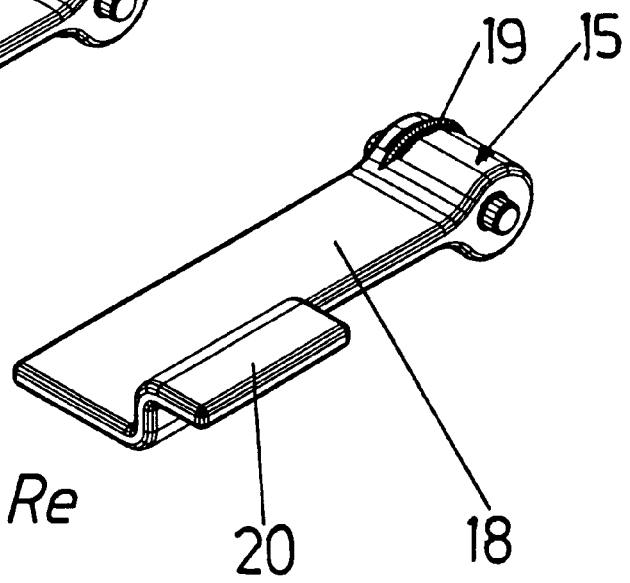

FIG. 14 shows a cross section of a drawer side wall 1, whereby the front holding device 14 and the roller 15 are shown in the position in which the bottom plate 7 is insertable into the drawer side wall 1. By turning the handle 18 and the roller 15, the bottom plate 7 is drawn to the vertical flange of the drawer side wall 1 because of the inclined cutting ring 19.

Therefore, the rollers 15 which are situated near the front end of the drawer side wall 1 have different cutting rings 19 depending on whether the drawer side wall 1 is positioned on the right or left side of the drawer.

The rollers 15 having two cutting rings 19 which are positioned near the rear end of the drawer side wall 1 are always the same regardless on which side of the drawer the drawer side wall 1 is positioned.

What is claimed is:

1. A drawer side wall comprising an upper frame part having a cover strip which covers a lateral edge of a bottom plate of a drawer;

a lower rail part rigid with said upper frame part, said rail part having a horizontal supporting flange for supporting said drawer bottom plate;

whereby at least one manually operable clamping device is mounted on said horizontal supporting flange for clamping said drawer bottom plate toward said cover strip.

2. A drawer side wail as claimed in claim 1, wherein said at least one clamping device is turnable around an axis passing through said clamping device.

3. A drawer side wall as claimed in claim 1, wherein two clamping devices are provided.

4. A drawer side wall as claimed in claim 3, wherein said two clamping devices are turnable around two horizontal axes, said axes being perpendicular to each other.

5. A drawer side wall as claimed in claim 1, wherein said clamping device comprises a thread bolt.

6. A drawer side wall as claimed in claim 5, wherein said thread bolt is provided with a handle which is situated underneath said horizontal supporting flange.

7. A drawer side wall as claimed in claim 6, wherein said handle is an elongated handle which is parallel to said drawer side wall in its clamping position.

8. A drawer side wall as claimed in claim 5, wherein said thread bolt is provided with a point directed towards said bottom plate.

9. A drawer side wall as claimed in claim 5, wherein said thread bolt is at its end directed towards said bottom plate, provided with a holding disc which holds the bottom plate by clamping.

10. A drawer side wall as claimed in claim 9, wherein said holding disc is provided with a point directed towards said bottom plate.

11. A drawer side wall as claimed in claim 9, wherein said holding disc is provided with a cutting rim.

12. A drawer side wall as claimed in claim 9, wherein said horizontal flange is provided with a recess in which the holding disc is situated when in the non-clamping position.

13. A drawer side wall as claimed in claim 1, wherein said at least one clamping device is in the form of a roll with an axis of rotation which is parallel to said horizontal flange, said roll being provided with a handle.

14. A drawer side wall as claimed in claim 13, wherein the drawer side wall is provided with two rolls, a first roll being situated nearer to a rear end of the drawer side wall and having an axis of rotation which is aligned in longitudinal direction of said drawer side wall, and a second roll being situated nearer to a front end of the drawer side wall, the axis of rotation of said second roll being aligned in a horizontal plane and perpendicular to said drawer side wall.

15. A drawer side wall as claimed in claim 13, wherein the handle is a flat arm with a partially angle shaped form.

16. A drawer side wall as claimed in claim 13, wherein said roll is provided with at least one cutting ring.

17. A drawer side wall as claimed in claim 16, wherein at least one roll is provided with a cutting ring which has in a plane which is inclined to the axis of rotation of said roll.

* * * * *